United States Patent [19]

Dolenc

[11] Patent Number: 5,042,666

[45] Date of Patent: Aug. 27, 1991

[54] LAMINATED SANDWICH BAG

[76] Inventor: Ted Dolenc, 748 Rivertree Dr., Oceanside, Calif. 92054

[21] Appl. No.: 652,653

[22] Filed: Feb. 8, 1991

[51] Int. Cl.[5] ..... B65D 3/26

[52] U.S. Cl. ..... 206/606; 206/610

[58] Field of Search ..... 206/606, 610, 614; 229/DIG. 13

[56] References Cited

U.S. PATENT DOCUMENTS

| | | | |
|---|---|---|---|
| 1,094,427 | 4/1914 | Cook . | |
| 1,436,754 | 11/1922 | Chadwick . | |
| 1,692,244 | 11/1928 | Brell . | |
| 1,714,121 | 6/1927 | Barbeeri . | |
| 2,000,301 | 5/1935 | Snodgrass et al. | 229/DIG. 13 |
| 2,132,966 | 10/1938 | O'Brien | 99/180 |
| 2,210,302 | 8/1940 | Petter | 229/DIG. 13 |
| 2,227,236 | 2/1936 | Vogt | 206/56 |
| 2,479,581 | 8/1949 | Masci | 206/63.2 |
| 3,955,001 | 5/1976 | Kuepach | 426/111 |
| 3,967,773 | 7/1976 | Kaufmann | 206/606 |
| 3,972,468 | 8/1976 | Reid | 229/51 BP |
| 4,091,929 | 5/1978 | Krane | 206/602 |
| 4,349,110 | 9/1982 | Hayashi | 206/606 |
| 4,762,233 | 8/1988 | Sears et al. | 206/606 |
| 4,779,738 | 10/1988 | Akutsu | 206/627 |
| 4,858,766 | 8/1989 | Tsai | 206/628 |
| 4,930,906 | 6/1990 | Hemphill | 383/89 |

FOREIGN PATENT DOCUMENTS

| | | | |
|---|---|---|---|
| 88297 | 1/1937 | Sweden | 206/606 |

*Primary Examiner*—Gary E. Elkins

*Attorney, Agent, or Firm*—Calif K. Tervo

[57] ABSTRACT

A foldable sandwich bag includes a wall of laminated structure having an inner layer of waterproof, thin, easily tearable material, such as aluminum foil, and an outer wrap securely attached thereto to form a laminate. The outer layer is made of thicker, stronger, tear-resistant material, such as vinyl tape, and is configured in segments that can be torn away along with the attached inner layer to reveal the contents of the bag. The bag can be laminated in a flat configuration and formed into a bag with overlapping vertical seam and having a vertical separation between segments.

12 Claims, 1 Drawing Sheet

LAMINATED SANDWICH BAG

BACKGROUND OF THE INVENTION

1. Field of the Invention

This invention relates in general to sandwich bags and more specifically involves a waterproof laminated sandwich bag that can be peeled away as necessary to eat a sandwich contained therein.

2. Description of the Related Art

Eating a sandwich is often a messy affair. Long french bread sandwiches of the type commonly called "torpedo" or "hero" sandwiches are particularly difficult to eat without liquid and other sandwich material falling from the sandwich.

Conventionally, such sandwiches are placed in a common bag or in a bag formed of a wrap of water resistant paper. As the sandwich is eaten, the eater must move the remaining sandwich upward and crush or neck-down the bag or wrap below the bottom end of the sandwich. Such manipulation of the sandwich and bag is undesirable as the sandwich itself must often be handled by the eater's hands thereby soiling the hands or the sandwich or both. Sandwich parts always fall down into the bag and are squeezed and crushed and not eaten. In manipulating the sandwich to a higher position, sandwich parts often fall out anyway.

Therefore, there has been a need for an improved sandwich bag that does not require manipulation of the sandwich toward an opening as the sandwich is consumed.

It is further desirable that such a bag be easily foldable for storage.

It is further desirable that such a bag be easily manufactured.

It is further desirable that such a bag be waterproof.

It is further desirable that such a bag have favorable insulative properties.

SUMMARY OF THE INVENTION

According to the invention a sandwich bag includes a wall of laminated structure having an inner layer of waterproof, thin, easily tearable material, such as aluminum foil, and an outer wrap securely attached thereto to form a laminate. The outer layer is made of thicker, stronger, tear-resistant material, such as vinyl tape and and is configured in segments that can be torn away along with the attached inner layer to reveal the contents of the bag.

In a preferred embodiment, the bag is laminated in a flat configuration and is formed into a bag having an overlapping inner layer seam and a vertical intra-segment separation line.

Other features and many attendant advantages of the invention will become more apparent upon a reading of the following detailed description together with the drawings in which like reference numerals refer to like part throughout.

DETAILED DESCRIPTION OF THE INVENTION

Figure 1:
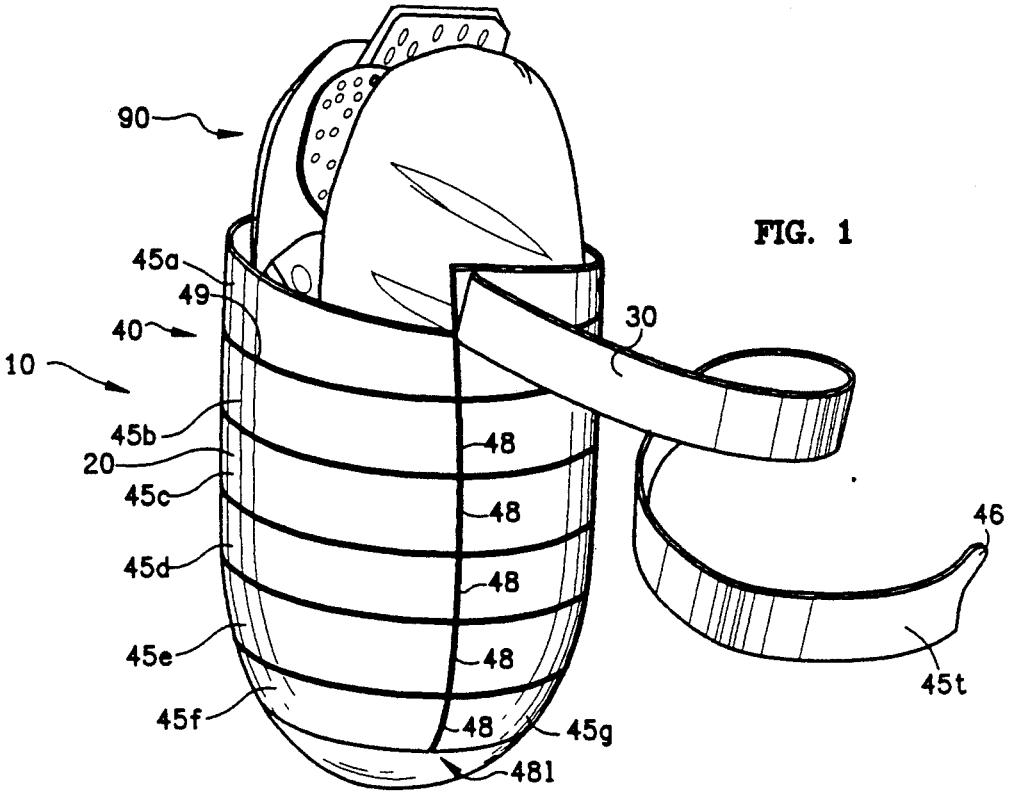
FIG. 1 is a perspective view of a preferred embodiment of the laminated sandwich bag of the present invention in use containing a torpedo sandwich.

With reference now to the drawings, and more particularly to FIG. 1 thereof, there is shown a perspective view of the laminated sandwich bag, denoted generally as 10, of the present invention containing a torpedo sandwich 90.

Figure 2:
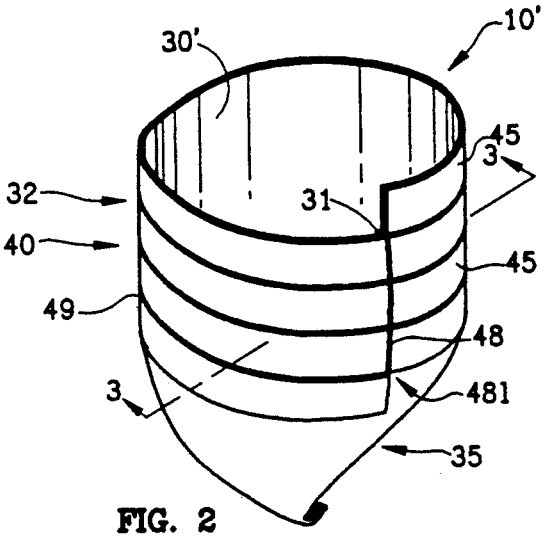
FIG. 2 is a perspective view, partially peeled away, of a second embodiment of the laminated sandwich bag of the present invention. The wall and seam thicknesses are exaggerated.
Figure 3:
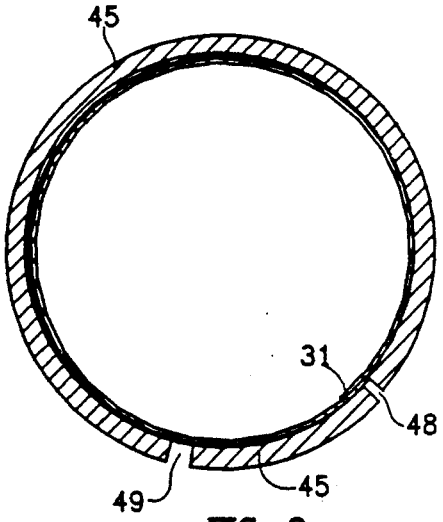
FIG. 3 is a slightly enlarged sectional view taken on line 3—3 of FIG. 2.

FIG. 2 illustrates a laminated bag 10 similar to that of FIG. 1 but with slightly different construction. FIG. 3 is a sectional view taken on line 3—3 of FIG. 2. The wall thickness shown in FIGS. 2 and 3 are exaggerated.

Bag 10 includes a wall 20 of laminated structure. Wall 20 includes an inner layer 30 and an outer wrap 40 securely attached, such as by glue or the like, to inner layer 30 to form a laminate.

Basically, bag 10 functions as follows: inner layer 30 is made of thin, but easily tearable, material, and outer wrap 40, of stiffer, stronger material, is laminated to inner layer 30 and is configured in segments that can be torn away along with the attached inner layer 30 to reveal the contents of the bag 10.

Inner layer 30 is made of thin, liquid-proof, easily tearable material, such as aluminum foil of approximately 0.0005–0.0010 inches in thickness. Aluminum foil also desirable because it has good infrared heat reflection properties to aid in maintaining the temperature of the contents of the bag 10. Other, thin, easily tearable materials may be used.

Outer wrap 40 is of strong, tear-resistant material. Vinyl of 0.002–0.005 inches thickness has been found to be suitable; a preferred embodiment incorporates decorated vinyl tape of 0.003 inches thickness. Vinyl has high tensile strength and is highly resistant to tear, but it is thin enough and elastic enough to allow the bag 10 to be folded flat for storage, packing and shipping of the bags. Outer material, such as fiber paper may be used if greater insulative qualities are desired.

Preferably, outer wrap 40 is in segments as denoted by 45*a*–45*g* and 45*t*. Top segment 45*t* is shown already being peeled off bag 10 to expose sandwich 90 for eating. Top segment 45*t* has a tab 46 at its beginning. Tab 46 is not laminated to inner layer 30 and is available for grasping as an aid in starting the first segment 45*t* for tearing and peeling.

In the preferred embodiment of FIG. 1, outer wrap 40 is a helix or spiral strip approximately three-quarters of an inch wide. The outer wrap is a single layer, that is there is not overlap at the seams. Outer wrap 40 is divided into shorter segments 45 terminating at vertical separations 48 such that each segment 45 can be individually torn off and discarded. In this manner, a long strip of bag material does not have to be continually handled. Means, such as vertical separations 48, divide segments 45.

In FIG. 2, the thickness of wall 20 has been greatly exaggerated to aid in explanation.

The top segments of bag 10' have been peeled off and only the bottom half of the bag 10' is shown. The top half is basically a mirror image of the bottom. Segments 45 of outer layer 40 have abutting end seams 48 and abutting side seams 49. These are shown with exaggerated width in FIGS. 2 and 3. Upon removal of each segment 45, inner layer 30 shears or tears along side seams 49 and then end seam 48

In one method of manufacture of bag 10, inner layer 30' comprised of a sheet of aluminum foil is wrapped around a cylindrical mandrel and bonded on overlapping seam 31, such as with heat or glue. Outer wrap 40' is wrapped around what is to be the basically cylindrical middle section 32 of the bag 10'. Bag 10' is removed from the cylindrical mandrel and the lower end section 35 is formed by tapering the uncovered lower end of inner layer 30 and sealing it such as shown for lower end section 35 in FIG. 2. The top end, not shown, may be formed in a similar manner or may be left open for insertion of a sandwich or the like. Alternatively, on the top end of bag 10, the outer wrap 40 may cover all or substantially all of the top end of the bag, depending on the particular use of the bag.

In an alternate preferred method of construction as may be depicted in the figures, the outer wrap segments are bonded to the inner wrap in a planar or flat configuration and then this lamination is curved to form the bag 10. As a result, the bag 10 has an overlaping inner layer seam 31 and a termination line 481 that is continuous from the bottom to the top of outer wrap 40.

Removal of the first (top) segment 45*t*, not shown in FIG. 2, removes any uncovered top end section of the inner layer 30 located above it. This construction allows the outer wrap to be of relatively uniformly shaped segments and for the bag to be easily folded flat for storage. The thick walled central laminated portion 32', being essentially cylindrical, will fold flat, and the end portions of thin aluminum foil will also.

Outer wrap 40 may include decoration or printing on its outer surface.

From the foregoing description, it can be seen that the bag 10 of the present invention provides an extremely efficient and reliable manner of holding a sandwich for consumption. Although particular embodiments of the invention have been illustrated and described, various changes may be made to the form, construction, and arrangement of the parts without sacrificing any of its advantages, and it is intended to cover in the appended claims such modifications and changes as come within the true spirit and scope of the invention.

I claim:

1. A laminated sandwich bag comprising:

an inner layer bag of thin, water proof material of low shear strength having a midsection and top and bottom ends; and an outer wrap of thicker, higher tensile strength material laminated to said inner bag over at least said inner bag midsection and comprising a strip of material wrapped in a helix on said inner layer such that peeling away of said strip concurrently tears and peels the underlying inner bag.

2. The laminated sandwich bag of claim 1 wherein: said outer layer strip is comprised if individually removable segments.

3. The laminated sandwich bag of claim 1 wherein: said inner layer is made of aluminum foil.

4. The laminated sandwich bag of claim 3 wherein: said aluminum foil is of 0.0005–0.0010 thickness.

5. The laminated sandwich bag of claim 1 wherein: said outer layer is made of vinyl.

6. The laminated sandwich bag of claim 1 wherein: said outer layer includes a top end having a tab for grabbing.

7. A laminated sandwich bag comprising:

an inner layer bag of thin, water proof material of low shear strength having a midsection and top and bottom ends; and an outer wrap of thicker, higher tensile strength material laminated to said inner bag over at least said inner bag midsection and comprising:

a plurality of strips of material wrapped around said inner layer such that peeling away of each said strip concurrently tears and peels the underlying inner bag and removal of each said strip removes the remaining inner bag laminated thereto and bag material above above said removed strip.

8. The laminated sandwich bag of claim 7 wherein: said inner layer is made of aluminum foil.

9. The laminated sandwich bag of claim 8 wherein: said aluminum foil is of 0.0005–0.0010 thickness.

10. The laminated sandwich bag of claim 7 wherein: said outer layer is made of vinyl.

11. The laminated sandwich bag of claim 7 wherein: said strips are separated at their ends by at least one continuous termination line form bottom to the top of said outer wrap.

12. A laminated sandwich bag comprising:

an inner layer bag of thin, water proof material of low shear strength having a midsection and top and bottom ends; said midsection being a sheet of said thin material formed in a closed curve and having a vertical overlapping seam; and an outer wrap of thicker, higher tensile strength material laminated to said inner bag over at least said inner bag midsection and comprising a strip of material wrapped in a helix on said inner layer such that peeling away of said strip concurrently tears and peels the underlying inner bag.

* * * * *